US007102095B2

(12) United States Patent
Blohm

(10) Patent No.: US 7,102,095 B2
(45) Date of Patent: Sep. 5, 2006

(54) CO-MAILING APPARATUS AND METHOD

(75) Inventor: Eric E. Blohm, West Allis, WI (US)

(73) Assignee: Quad/Graphics, Inc., Sussex, WI (US)

( * ) Notice: Subject to any disclaimer, the term of this patent is extended or adjusted under 35 U.S.C. 154(b) by 125 days.

(21) Appl. No.: 10/286,531

(22) Filed: Nov. 1, 2002

(65) Prior Publication Data

US 2003/0093179 A1 May 15, 2003

(51) Int. Cl.
*B65H 39/06* (2006.01)

(52) U.S. Cl. ..... 209/584; 209/900; 270/52.01

(58) Field of Classification Search ..... 209/583, 209/584, 900, 933; 53/154, 461, 52, 491; 700/220, 221, 223, 224; 198/444, 447, 448; 270/52.01
See application file for complete search history.

(56) References Cited

U.S. PATENT DOCUMENTS 4,683,708 A 8/1987 Linder
4,790,119 A 12/1988 McDaniels
5,007,521 A * 4/1991 Tanaka ..... 198/347.4
5,025,610 A 6/1991 Graushar
5,113,639 A 5/1992 Bryson
5,189,863 A 3/1993 Pozzi
5,333,437 A 8/1994 Conti
5,439,340 A 8/1995 Volkmann
5,706,632 A * 1/1998 Kivits et al. ..... 53/443
5,720,157 A * 2/1998 Ross ..... 53/445
5,950,401 A 9/1999 Blohm et al.
6,122,899 A 9/2000 Soderling
6,199,348 B1 3/2001 Button et al.
6,269,609 B1 8/2001 Graushar et al.
6,415,582 B1 7/2002 Graushar et al.
2003/0062293 A1* 4/2003 Graushar et al. ..... 209/1
2003/0131567 A1* 7/2003 Timmerman et al. ..... 53/450

OTHER PUBLICATIONS

U.S. Appl. No. 60/326,324, filed on Oct. 1, 2001, Graushar et al.*

* cited by examiner

*Primary Examiner*—Joseph Rodriguez
(74) *Attorney, Agent, or Firm*—Michael Best & Friedrich LLP

(57) ABSTRACT

The combination of a first and a second product mail streams wherein the first stream includes wrapped products and the second stream includes unwrapped products.

16 Claims, 1 Drawing Sheet

CO-MAILING APPARATUS AND METHOD

FIELD OF THE INVENTION

The invention relates to co-mailing a first and a second mail stream of products, and more particularly, to co-mailing a first mail stream of wrapped products and a second mail stream of unwrapped products.

BACKGROUND OF THE INVENTION

Costs associated with the U.S. Postal Service are climbing. Publishers and printers are continually looking for ways to reduce postage costs.

SUMMARY OF THE INVENTION

The invention includes the co-mailing of a first mail stream of wrapped products with a second mail stream of unwrapped products according to a predetermined sequence.

The invention particularly includes a process to combine wrapped and unwrapped products into one mail stream including generating a master mailing list of products having a predetermined sequence, generating a first mail stream, wrapping all of the products in the first mail stream, generating a second mail stream of unwrapped products, and combining the first stream of wrapped products and the second mail stream of unwrapped products into a single mail stream according to the predetermined sequence.

Further, the invention includes a co-mailing line including a first path which generates a first mail stream of wrapped products, the first path including at least one feeder for delivering unwrapped products to a conveyor, a wrapper for wrapping the products, and an accumulator for storing the wrapped products, a second path which generates a second mail stream of unwrapped products, the second path including at least one feeder for delivering unwrapped products to a conveyor, a controller having inputted a master mailing list of products, a combination area wherein the wrapped products of the first mailing stream exiting the accumulator are combined with the unwrapped products of the second mail stream in a sequence as determined by the controller to produce a third mail stream, and a third path for the conveying the third mail stream for further processing.

Other features and advantages of the invention will become apparent to those of ordinary skill in the art upon review of the following drawing and detailed description.

Figure 1:
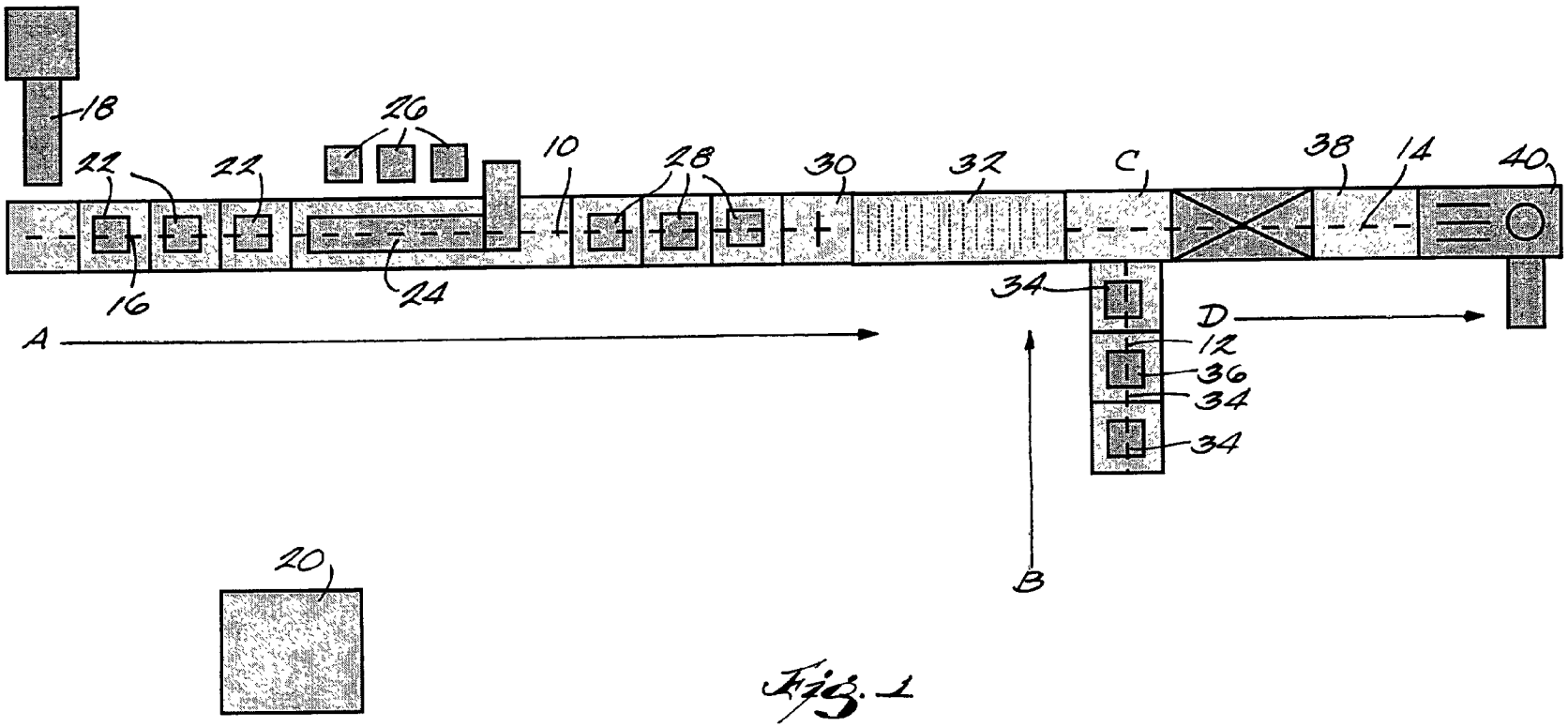
FIG. 1 is a schematic of a process and apparatus embodying the invention.

Before the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION

Referring now to FIG. 1, there is shown an apparatus and process for co-mailing two streams of product. Briefly, a first mail stream of product 10 travels along path A and a separate, second mail stream of product 12 travels along path B. The two paths A and B converge at point C wherein the two stream are combined into a single or third mail stream 14 that thereafter travels along path D.

More specifically, the first mail stream of products 10 preferably is a stream of printed products that are wrapped. In addition to being wrapped, individual products may include components that are insertable into an envelope, with the envelope being wrapped along with the product. The components can include pieces printed inline or offline or not printed at all such as CD-ROM's, or other electronic media. As an example, the component could be a personalized subscriber invoice laser printed off-line and fed to a gathering chain or conveyor 16 on path A via a feeder 18. This first component preferably would include thereon a code such as a bar code, human readable numbers or some type of printed indicia with such code being used to communicate to a controller 20 a sequence number on the component such that a correct product will be matched with the component before wrapping. The sequence number on the first component is read and communicated to the controller 20. The controller 20 then controls feeders 22 that selectively feed other components or inserts onto the gathering chain 16. The first component is therefore matched with the selectively fed subsequent components. The first and subsequent components are then inserted into an envelope by an envelope inserter 24. Preferably, there is more than one feeder 26 of envelopes. The controller 20 controls which envelope type is feed to the gathering chain 16 for insertion of all components.

The envelope containing the one or more components continues on the gathering chain 16 to the feeders 28. The feeders 28 selectively feed unwrapped products onto the gathering chain 16 as controlled by the controller 20. Each product fed to the gathering chain 16 therefore matches up with any associated envelope and its contents. The envelope and matched product continue down the gathering chain 16 and are wrapped together by a conventional wrapper 30. The wrapper material may be paper or poly or any other suitable material. The wrapped products then enter an accumulator 32 where they are stored until they are fed on demand as is described next.

Turning now to the second mail stream 12, products that have not and will not be wrapped are fed from hoppers 34 onto a gathering chain 36 to form path B. The products are then conveyed to station or combination area C. At station C, the first mail stream 10 and the second mail stream 12 are combined to form a single or third mail stream 14 in a predetermined order. That predetermined order is derived from a master sequence or master mailing list know to the controller 20. For example, the sequence can be in zip code or other address-related order. The controller 20 commands the hoppers 34 to begin feeding products in sequence to the gathering chain 36. The stream however is designed to have gaps or holes in it through the sequence as controlled by the controller 20.

The wrapped products from the first stream 10 are fed on demand from the accumulator 32 into the appropriate gaps as controlled by the controller 20 to produce a combined stream of products in the predetermined sequence of the master list. With the use of the accumulator 32, if there is a problem with the feeders 22 or 26 upstream, the process of combining the first and second mail streams 10 and 12 can continue as long as there is product in the accumulator 32, giving an operator time to fix any upstream problem before the whole co-mailing line has to be stopped for maintenance.

After the first and second mail streams 10 and 12 are combined at the station C, the combined or third mail stream 14 is conveyed to an optional ink jet area 38 where address or other indicia can be selectively printed on the products and then conveyed to a conventional stacker 40 for further conventional processing.

The titles of the products of the first and second mail stream can be different, and similarly, the titles within a mail stream, first or second, can be different. The products can include magazines, books, brochures, direct mail pieces, other printed products and the like.

What is claimed is:

1. A mailing line comprising:

a first path which commences with bound printed product which are wrapped by a wrapper to generate a first mail stream of wrapped products on a mailing line;

a second path which commences with bound printed product which are conveyed on a conveyor to generate a second mail stream of unwrapped printed products, the printed products in the second mail stream not previously combined with the printed products in the first mail stream;

a controller having inputted a master mailing list of products;

a combination area on the mailing line wherein the printed products of the first mail stream are merged with the printed products of the second mail stream to produce a third mail stream according to the master mailing list; and a third path for the conveying the third mail stream for further processing.

2. The mailing line of claim 1 wherein the third path includes an ink jet station and a stacker.

3. The mailing line of claim 1 wherein the first path further includes at least one insert feeder for feeding inserts to the conveyor to be wrapped with a particular product of the first mail stream.

4. The mailing line of claim 1 wherein the products of the first mail stream include different titles.

5. The mailing line of claim 1 wherein the products of the second mail stream include different titles.

6. A process to combine wrapped and unwrapped products in separate mail streams into one mail stream on a mailing line, the process comprising:

generating a master mailing list of products having a predetermined sequence;

generating a first mail stream on the mailing line, the first mail stream commencing with bound printed product;

wrapping all of the printed products in the first mail stream;

generating a second mail stream of unwrapped products on the mailing line, the second mail stream commencing with bound printed product which are conveyed on a conveyor, the printed products in the second mail stream not previously combined with the printed products in the first mail stream; and merging the first stream of wrapped products and the second mail stream of unwrapped products into a single mail stream on the mailing line according to the predetermined sequence.

7. The process of claim 6 wherein the first mail stream of products and the second mail stream of products include different titles.

8. The process of claim 6 wherein in the wrapping step, the wrapper utilizes one of paper and poly material.

9. The process of claim 6 wherein the predetermined sequence is based upon address information.

10. The process of claim 6 wherein the products of the first mail stream are wrapped with at least one other component.

11. A process to combine wrapped and unwrapped products in separate mail streams into one mail stream on a mailing line, the process comprising:

generating a master mailing list of products having a predetermined sequence;

generating a first mail stream by feeding unwrapped products to a first path on a mailing line, the first mail stream commencing with bound printed product;

wrapping all of the printed products in the first mail stream using a wrapper;

holding the first stream of wrapped products;

generating a second mail stream on the mailing line downstream of the wrapper by feeding unwrapped products to a second path, the second mail stream commencing with bound printed product, the printed products in the second mail stream not previously combined with the printed products in the first mail stream; and merging the first stream of wrapped products and the second mail stream of unwrapped products into a single mail stream on a third path according to the predetermined sequence.

12. The process of claim 11 wherein the first mail stream of products and the second mail stream of products include different titles.

13. The process of claim 11 wherein in the wrapping step, the wrapper utilizes one of paper and poly material.

14. The process of claim 11 wherein the predetermined sequence is based upon address information.

15. The process of claim 11 wherein the products of the first mail stream are wrapped with at least one other component.

16. The process of claim 11 wherein the products of the first and the second mail stream are magazines.

* * * * *